US008608530B2

(12) United States Patent
Hofmann et al.

(10) Patent No.: US 8,608,530 B2
(45) Date of Patent: Dec. 17, 2013

(54) INSERTION TOOL FOR A MACHINE TOOL

(75) Inventors: Albrecht Hofmann, Steinenbronn (DE); Harald Krondorfer, Mundelein, IL (US); Thomas Schomisch, Filderstadt (DE); Christof Hoelzl, Vomp (AT); Johann Huber, Kramsach (AT); Marcus Heckmann, Leinfelden-Echterdingen (DE); Kersten Heckmann, legal representative, Leinfelden-Echterdingen (DE)

(73) Assignee: Robert Bosch GmbH, Stuttgart (DE)

( * ) Notice: Subject to any disclaimer, the term of this patent is extended or adjusted under 35 U.S.C. 154(b) by 1933 days.

(21) Appl. No.: 10/564,669

(22) PCT Filed: Nov. 8, 2004
(Under 37 CFR 1.47)

(86) PCT No.: PCT/EP2004/052875

§ 371 (c)(1),
(2), (4) Date: Jan. 13, 2006

(87) PCT Pub. No.: WO2005/061179

PCT Pub. Date: Jul. 7, 2005

(65) Prior Publication Data

US 2006/0172668 A1 Aug. 3, 2006

(30) Foreign Application Priority Data

Dec. 20, 2003 (DE) ..... 103 60 246

(51) Int. Cl.
*B24B 23/00* (2006.01)

(52) U.S. Cl.
USPC ..... 451/359; 451/353; 451/509

(58) Field of Classification Search
USPC ..... 451/344, 353, 359, 509, 342; 125/15
See application file for complete search history.

(56) References Cited

U.S. PATENT DOCUMENTS

| | | | | |
|---|---|---|---|---|
| 2,747,343 | A * | 5/1956 | Gellert | 451/342 |
| 5,207,028 | A * | 5/1993 | Timmons | 451/342 |
| 6,780,093 | B2 * | 8/2004 | Krondorfer et al. | 451/344 |
| 6,786,811 | B2 * | 9/2004 | Krondorfer et al. | 451/342 |
| 6,942,560 | B2 * | 9/2005 | Hofmann et al. | 451/359 |
| 7,077,735 | B2 * | 7/2006 | Krondorfer et al. | 451/359 |
| 2003/0129933 | A1 * | 7/2003 | Wendt et al. | 451/342 |
| 2003/0162487 | A1 * | 8/2003 | Krondorfer et al. | 451/359 |
| 2003/0176153 | A1 * | 9/2003 | Krondorfer et al. | 451/359 |
| 2003/0181152 | A1 * | 9/2003 | Hofmann et al. | 451/342 |

FOREIGN PATENT DOCUMENTS

WO 03/097299 11/2003

* cited by examiner

*Primary Examiner* — Eileen P. Morgan
(74) *Attorney, Agent, or Firm* — Michael J. Striker

(57) ABSTRACT

The present invention is directed to an insertion tool (12) for a machine tool that has a hub (16) with at least one opening (42, 80) for insertion of a fastening means (40, 84), via which the hub (16) is clampable on a driving flange (22) of the machine tool connected to a drive shaft, the opening (42, 80) including a retaining region (54) and a releasing region (56), the releasing region (56) including a stop (66, 88) for limiting a release motion of the fastening means (40, 84).
It is provided that the opening (42, 80) adjacent to the stop (66, 88) has a convex section (76, 90).

13 Claims, 7 Drawing Sheets

INSERTION TOOL FOR A MACHINE TOOL

CROSS-REFERENCE

The invention described and claimed hereinbelow is also described in PCT/EP 2004/052875, FILED ON Nov. 8, 2004 and DE 10360246.1, filed Dec. 20, 2003. This German Patent Application, whose subject matter is incorporated here by reference, provides the basis for a claim of priority of invention under 35 U.S.C. 119 (a)-(d).

BACKGROUND OF THE INVENTION

The present invention is directed to an insertion tool for a machine tool.

Publication WO 03/097299 makes known an insertion tool for a machine tool that includes a hub with openings for fastening the hub onto a driving flange of the machine tool. To fasten the insertion tool on the driving flange, the hub is slid onto a centring collar, three fastening means configured as hooks extending through three openings in the hub. When the hub is subsequently rotated relative to the hooks, the hooks latch over the hub and retain it in the axial direction on the driving flange. When a fastening position is reached, retaining bolts snap into recesses provided therefor. The insertion tool is now secured in the tangential direction by the retaining bolts and are retained on the driving flange in the axial direction by the fastening hooks.

To release the insertion tool, the retaining bolts are pressed through the recesses by actuating a release button, by way of which the insertion tool and, with it, the hub, are capable of being turned back in the tangential direction, also referred to as the circumferential direction. The fastening hooks can be disengaged from the hub and the insertion tool can be removed from the driving flange.

SUMMARY OF THE INVENTION

The present invention is directed to an insertion tool for a machine tool that has a hub with at least one opening for insertion of a fastening means, via which the hub is clampable on a driving flange of the machine tool connected to a drive shaft, the opening including a retaining region and a releasing region, the releasing region including a stop for limiting a release motion of the fastening means.

It is provided that the opening has a convex section adjacent to the stop. With a stop, the hub can be brought into a very exact position relative to the driving flange when the fastening means hits the stop. As a result, the hub and, with it, the insertion tool, can be removed from the driving flange without catching. By way of the convex section of the opening, the stop and an opening space can be created, through which an overhanging element of the fastening means that can be used to securely retain the hub on the driving flange can be guided without catching. A reliable, simple detachment of the insertion tool from the driving flange can be obtained in conjunction with a secure retention of the hub and a simple and economical manufacture of the fastening means. The convex section can be located directly adjacent to the stop, or in a center region of the stop. The distance between the convex section and the stop is, at the maximum, half of the distance between the stop and the retaining region of the opening.

Advantageously, the convex section directly abuts a straight section of the opening that forms the stop, by way of which a hook-free design of the hub can be obtained, combined with a particularly simple manufacture of the hub and the fastening means.

Instead of the retaining region and the release region, the opening can have a first and second region, the second region being wider in the radial direction than the first region. The release motion of the fastening means can be described, in particular, as a motion of the fastening means oriented in the tangential direction away from the retaining region into the release region.

Even more advantageously, the opening has a section that, in the tangential direction, is at least 2 mm and, in particular, at least 3 mm, further away from the retaining region than the stop. As a result, a rear region of the opening is formed that is at least 2 mm or 3 mm further away from the retaining region than the stop. An overhanging element of the fastening means can be guided through this region, the element being capable of providing a high-level of stability of the connection of the hub with the driving flange.

As a further advantageous embodiment of the present invention, it is provided that the stop is oriented such that it is rotated by an angle between 2° and 10° and, in particular, between 4° and 7°, against a direction of rotation of the release motion of the fastening means (40, 84) relative to the radial direction. To release the insertion tool from the driving flange, the hub is rotated relative to the driving flange and relative to the fastening means. As a result, the fastening means completes a release motion in a release direction relative to the stop. The release motion moves in a direction of rotation, e.g., in the clockwise direction, toward the stop, and is limited by the stop. With an orientation of the stop as described, an easily-made fastening means with parallel lateral surfaces can impact the stop squarely. A deformation of the stop can be counteracted. By way of the minimal rotation relative to the radial direction, an elastic evasive maneuver or a pressing-away of the fastening means from the stop can also be largely avoided.

A simple fastening and release of the insertion tool to or from the driving flange can be achieved when the opening has a convex, in particular radially inner section oriented in the tangential direction. By rotating the hub, the fastening means can be guided into the retaining region and back without an elastic deformation of the release region, by way of which the fastening motion or release motion can be designed to be very smooth.

By configuring the opening such that the opening has two parallel, interconnected slots, it can be ensured in a particularly simple manner that the insertion tool is not installed in a laterally reversed manner on the driving flange.

Advantageously, each of the slots is at least substantially right-angled; this ensures that a particularly reliable safeguard against laterally-reversed installation can be achieved. The right-angled configuration is retained when the slots are formed by straight sections that are interconnected by radii. In this context, a section that is oriented in the tangential direction and therefore has a curved configuration is referred to as a straight line.

A simple fastening and releasing of the insertion tool on to or off of the driving flange can be achieved via a rotational motion of the hub when each of the slots is oriented in the tangential direction.

A particularly reliable fastening of the insertion tool on the driving flange can be obtained when the hub includes retaining means for fixing the hub in the tangential direction. Retaining means of this type can be openings or recesses into which the fastening means can be inserted to tangentially secure the insertion tool. These retaining means are advantageously separated by the opening, by way of which a high level of stability of the retaining means and the opening can be achieved.

It is also provided that the hub contains a centering opening for centering the hub. By centering, a pre-positioning of the insertion tool on the driving flange is achieved; this allows the fastening means to be easily guided through the opening.

An encoding and definition of a rotary position of the insertion tool when it is slid onto a centring collar can be obtained when the centring opening has at least one radial recess. This recess surrounds, e.g., an encoding raised area on the driving flange, which can prevent non-permitted insertion tools from being fastened to the driving flange. In addition, the radial recess in the centring opening can be configured such that the fastening means can be inserted directly through the opening when the recess grips around the raised area.

BRIEF DESCRIPTION OF THE DRAWINGS

Further advantages result from the description of the drawing, below. Exemplary embodiments of the present invention are shown in the drawing. The drawing, the description and the claims contain numerous features in combination. One skilled in the art will also advantageously consider the features individually and combine them to form further reasonable combinations.

DETAILED DESCRIPTION OF THE EXEMPLARY EMBODIMENTS

Figure 1:
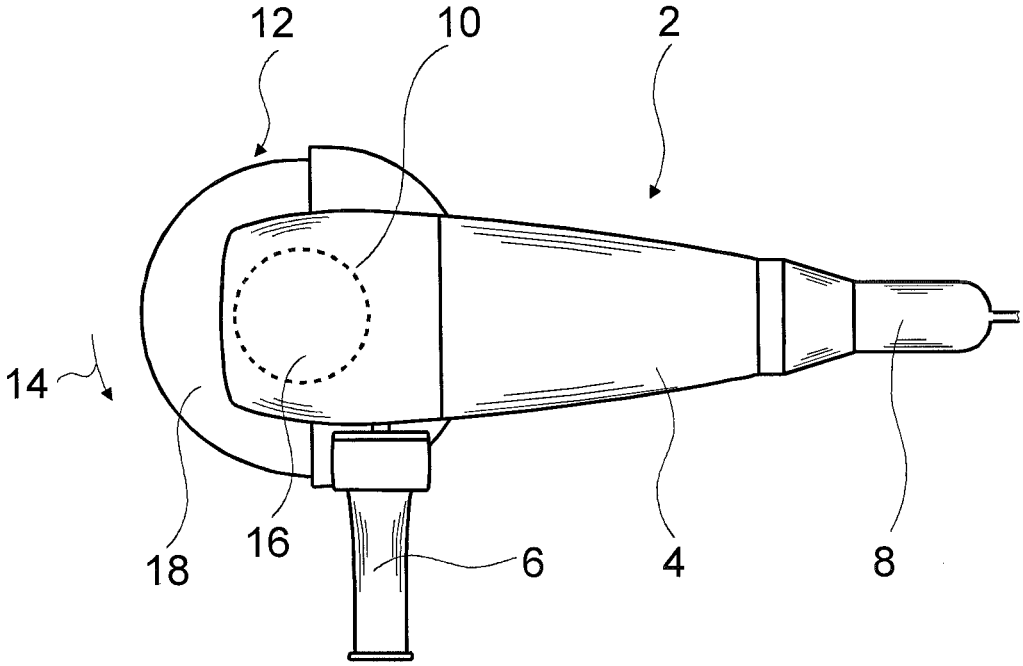
FIG. 1 Shows an angle grinder with a cutting disc.
Figure 1A:
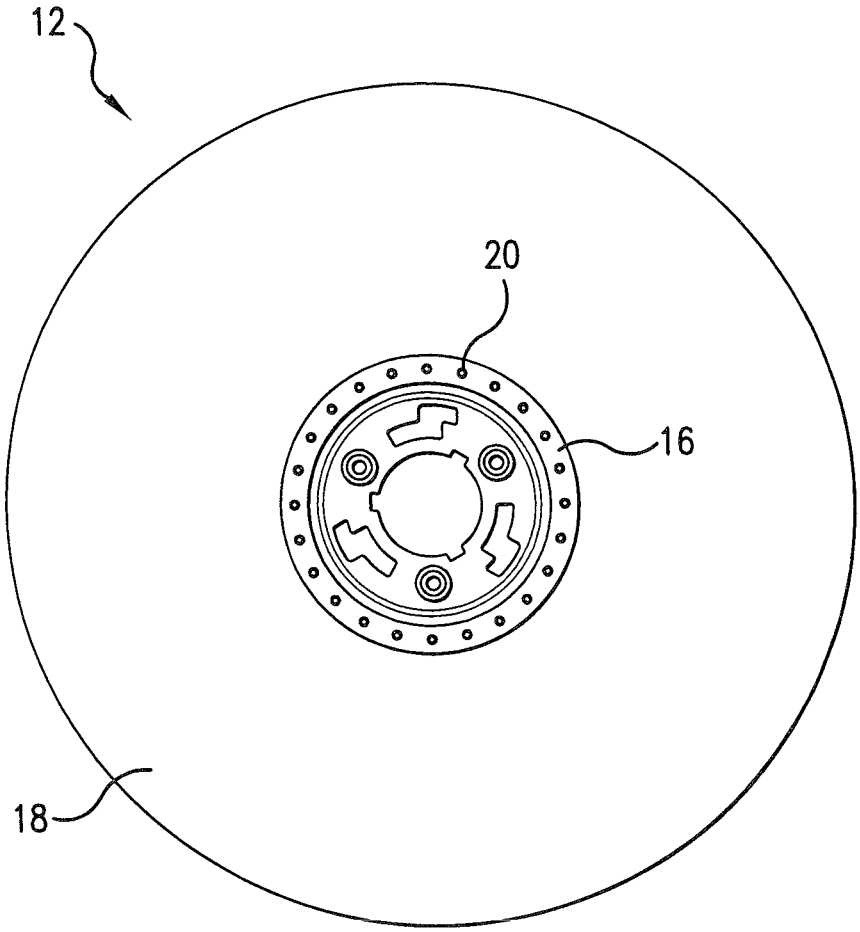
FIG. 1A Shows the insertion tool including a hub and an abrasive body.
Figure 1B:
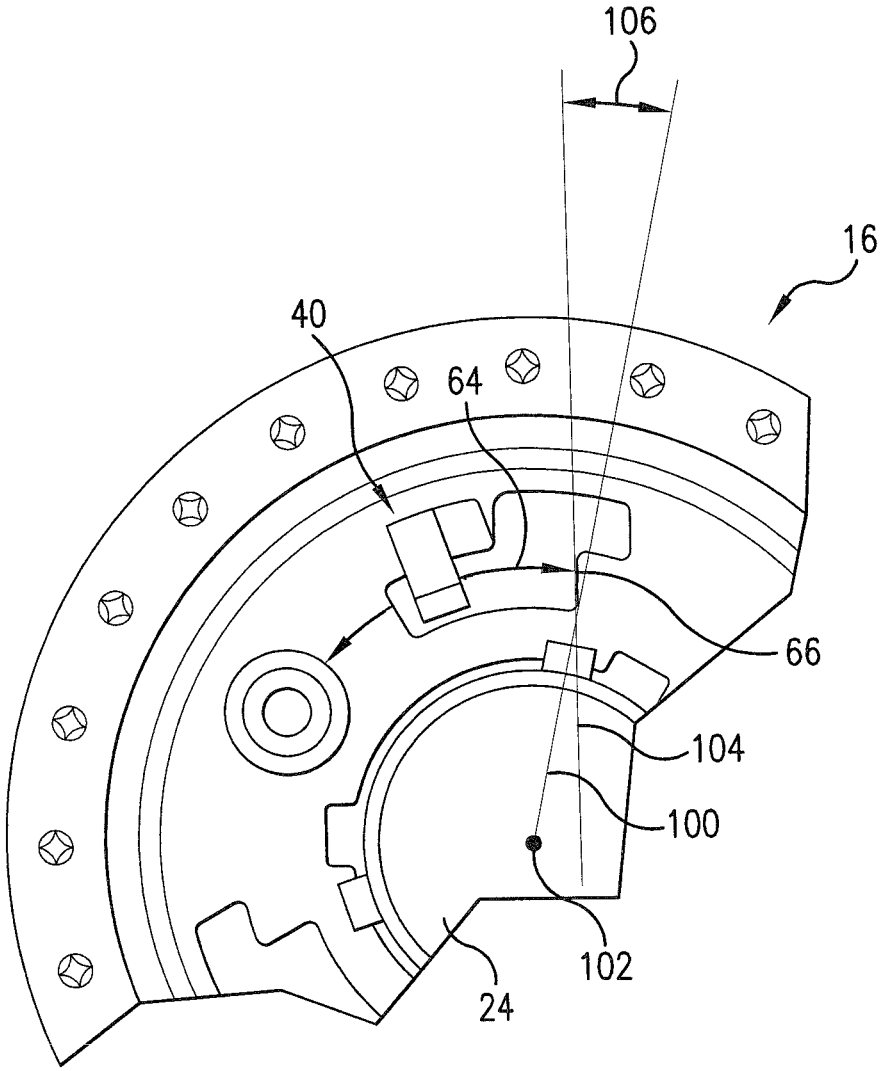
FIG. 1B Shows a hub opening of the insertion tool including a stop in the releasing region oriented after rotation by an angle of between 2 and 10 degrees against a direction of rotation of a release motion of fastening means relative to the radial direction, FIG. 2 Shows a hub of the cutting disc over a driving flange of the angle grinder, FIG. 3 Shows a top view of the hub in FIG. 2, FIG. 4 Shows the hub slid onto the driving flange, in a detained view, FIG. 5 Shows the hub fastened to the driving flange, in a detained view, and FIG. 6 Shows a top view of an opening in a hub and a fastening means.

FIG. 1 shows an angle grinder 2 from above with a not-shown electric motor supported in a housing 4. Angle grinder 2 is guidable using a first handle 6 and a second handle 8, first handle 6 being fastened to a transmission housing 10 in the region of an insertion tool 12, and second handle 8 extending in the longitudinal direction and being integrated in housing 4 on a side facing away from insertion tool 12. Insertion tool 12 is drivable in direction of rotation 14 via the electric motor, a not-shown transmission, and a not-shown drive shaft.

Figure 2:
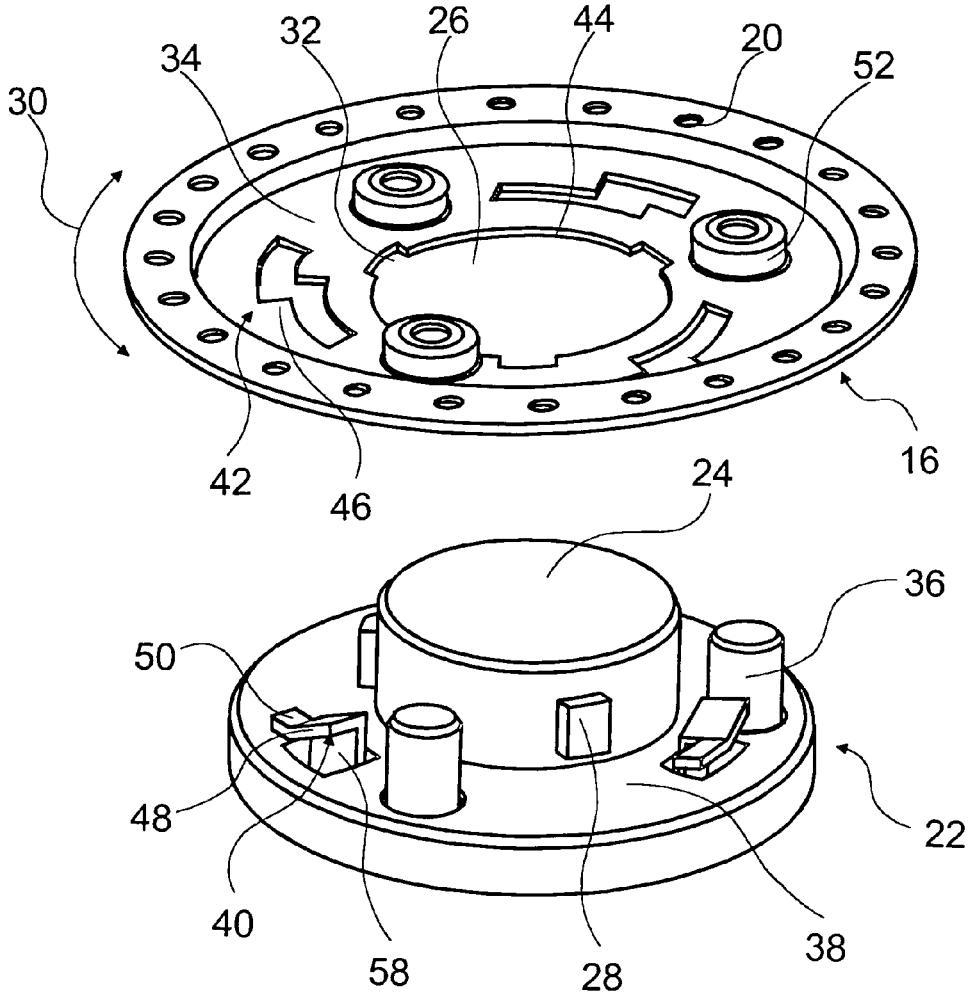

When angle grinder 2 is viewed not from the top, as in FIG. 1, but from the bottom, a hub 16 of insertion tool 12 can be seen. This hub is shown in FIG. 2. An abrasive body 18—shown in FIG. 1 —of insertion tool 12 is located around hub 16, abrasive body being fastened to hub 16 with the aid of fastening elements 20. Hub 16 of insertion tool 12, wherein the insertion tool is designed as a cutting disc, is shown in FIG. 2 in a perspective, exploded view above a driving flange 22 of angle grinder 2. This driving flange 22 surrounds a centring collar 24, onto which hub 16 can be slid with a centring opening 26.

After insertion, hub 16 rests with its radially innermost part on three encoding raised areas 28 that extend radially outwardly away from centring collar 24. When resting on these encoding raised areas 28, hub 16 can be rotated in tangential direction 30 until three radial recesses 32 are aligned with three encoding raised areas 28. In this position, hub 16—and with it, the entire insertion tool 12—drops down slightly until it comes to rest with its inner plate 34 on three snap-in bolts 36. These three snap-in bolts 36 are spring-loaded and can be pressed downward by an operator of angle grinder 2 against the pressure onto insertion tool 12. Hub 16 can now be pressed with its lower plate 34 until it reaches a base 38 of driving flange 22, by way of which fastening means 40 configured as hooks are guided through openings 42 in lower plate 34 of hub 16.

To fasten insertion tool 12 onto driving flange 22, hub 16 can now be rotated in the clockwise direction, by way of which a radially innermost region 44 of lower plate 34 can be guided underneath encoding raised areas 28. At the same time, a retaining region 46 of lower plate 34 adjacent to openings 42 is slid under a slanted ramp element 48 of fastening means 40, fastening means 40 being pulled slightly upward against the force of a non-shown, preloaded spring. An exact description of driving flange 22, spring-loaded snap-in bolt 36 and fastening means 40 is provided in publication WO 03/097299 described initially.

When insertion tool 12 is rotated further in the clockwise direction, retaining region 46 is slid under a retaining element 50 oriented parallel to base 38 of driving flange 22 that presses hub 16 onto base 38 with the aid of the preloaded, not-shown spring. When a fastening position is reached, snap-in bolts 36 are aligned with pot-shaped recesses 52 in hub 16 and snap into these recesses 52 by snapping upward. Recesses 52 are designed as deformations of lower plate 34; they are shown in FIG. 2 as substantially cylindrical raised areas. Hub 16 and, with it, entire insertion tool 12, are now fixed in tangential direction 30 by snap-in bolts 36 in pot-shaped recesses 52, and are retained in the axial direction by spring-loaded retaining elements 50.

Figure 3:
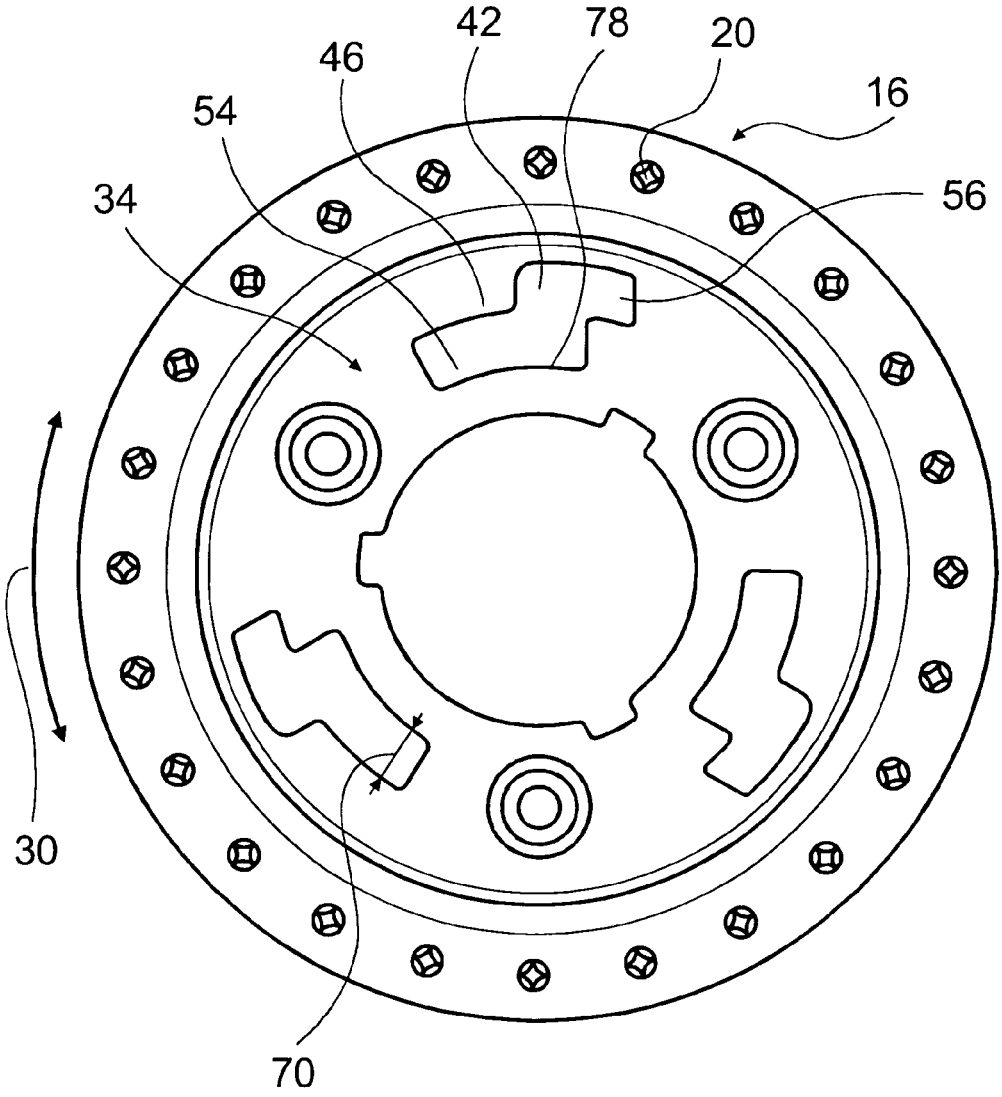

FIG. 3 shows hub 16 of insertion tool 12 in a top view. Hub 16 has three identically configured openings 42 and three identical retaining means configured as pot-shaped recesses 52 that extend out of the plane of the drawing, in the top view. Openings 42 are configured in the shape of two interconnected, parallel slots oriented in tangential direction 30. All of the slots are substantially right-angled. Due to the fact that opening 42 is designed in the shape of two right-angled slots, a laterally-reversed installation of insertion tool 12 onto an identical driving flange without encoding raised areas can be prevented, since fastening means 40 cannot be guided through an opening 42 situated such that it is laterally reversed in this manner.

Each of the openings 42 includes a retaining region 54 and a releasing region 56. When a fastening means 40 is located in releasing region 56, fastening means 40 can be guided through opening 42 to fasten or release hub 16. If hub 16 is in the state in which it is fastened on driving flange 22, a segment 58 of fastening means 40 is located in retaining region 54, and retaining element 50 and at least a portion of ramp element 48 extend over retaining region 46 of lower plate 34 of hub 16.

Opening 42 includes a radially inner section 78 oriented in the tangential direction. When hub 16 is rotated, segment 58 can be guided along this section 78 without being deflected.

Figure 4:
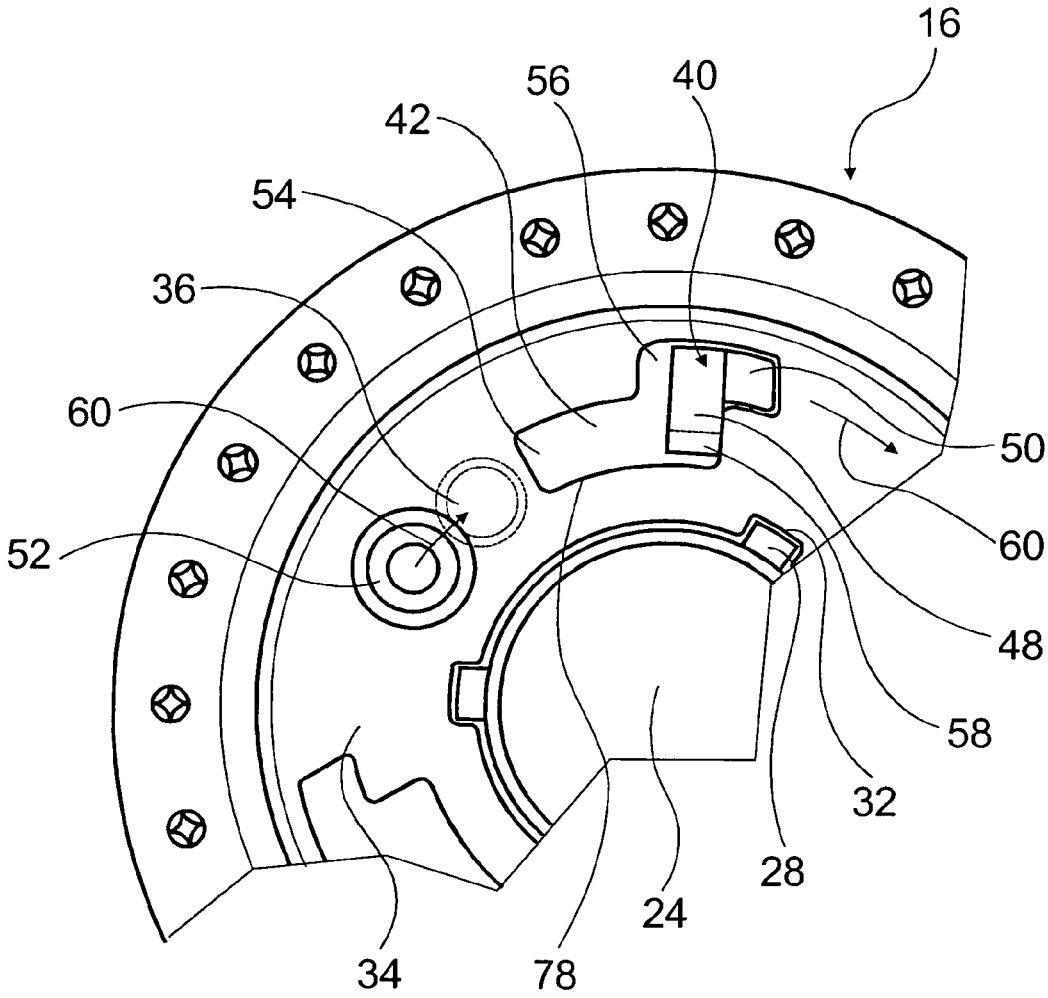
Figure 5:
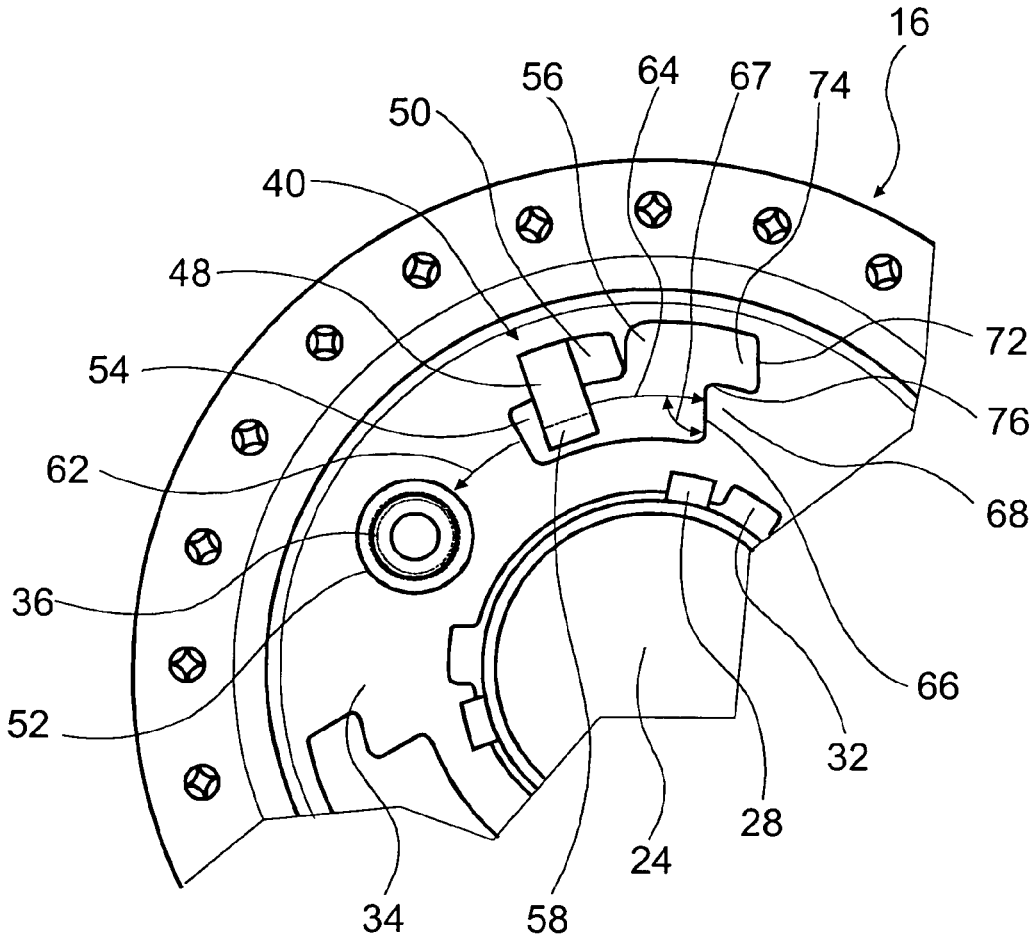

FIG. 4 shows a fastening means 40 guided through an opening 42 and a section of hub 16, in a top view. Hub 16 is located in a position relative to centring collar 24 such that recesses 32 in lower plate 34 are aligned with encoding raised areas 28 of centring collar 24. In this position, hub 16 can be pressed in the axial direction downward in the direction of plate 38, by way of which ramp element 48 and retaining element 50 of fastening means 40 are guided through releasing region 56. When hub 16 is rotated in the direction indicated by arrow 60, snap-in bolts 36 align with recesses 52, and segment 58 enters retaining region 54, as shown in FIG. 5.

Hub 16 is released from driving flange 22 by actuating a not-shown actuating button, by way of which snap-in bolts 36 are pressed downward and out of recesses 52. Hub 16 is now rotatable in the counterclockwise direction as indicated by arrow 62 (FIG. 5), by way of which fastening means 40 are moved in a release motion in release direction 64 into release region 56. The release direction is parallel to tangential direction 30 and is clockwise. The release motion in release direction 64 can be carried out by an operator of angle grinder 2 until segment 58 of fastening means 40 hits a stop 66 of opening 42. In this position, recess 32 is flush with encoding raised area 28 (FIG. 4), so that hub 16 can be lifted off of driving flange 22.

Stop 66 is not oriented entirely in the radial direction, but rather at an angle 67 of 95.5° to the release direction and/or tangential direction 30, and is therefore rotated in the counterclockwise direction by an angle of 5.5° to the radial direction. As a result, the right side wall of the two parallel side walls of segment 58 hits stop 66 squarely. Stop 66 is part of a bulge 68 in lower plate 34 of hub 16. Stop 66 and/or bulge 68 limits a release motion of hub 16. Without bulge 68, it would be possible for an operator of angle grinder 2—in order to release hub 16—to rotate hub 16 in the counterclockwise direction so far that retaining element 50 would extend over lower plate 34 again and recess 32 would not be aligned with encoding raised area 28. To release hub 16, the operator would have to rotate hub 16 and "feel" his way until encoding raised areas 28 are aligned with recesses 32. This difficult maneuver is eliminated by bulge 68 with stop 66.

Bulge 68 extends with a displacement path of approximately 3.2 mm into release region 56 against release direction 64. This corresponds to approximately 80% of a radial width 70 of retaining region 54, and values between 50% and 150% of radial width 70 are also suitable. Release region 56 therefore has a section 72 offset from stop 66 in release direction 64 by this very displacement path and is therefore further away from retaining region 54, in the tangential direction, from the displacement path, than stop 66. Section 72 limits a rear region 74 of opening 42, through which retaining element 50 can be guided when hub 16 is fastened to or released from driving flange 22.

To enable the configuration of a rear region 74 of this type, opening 42 has a convex section 76 adjacent to stop 66. This convex section 76 can be configured in a manner that appears suitable to one skilled in the art, e.g., with a radius or as a sharp corner. The presence of convex section 76 makes it possible to configure rear region 74 in release direction 64 behind stop 66. As a result, fastening means 40 can have a retaining element 50 that extends further in release direction 64 than segment 58 of fastening means 40. This enables a particularly simple, stable and economical manufacture of fastening means 40.

Figure 6:
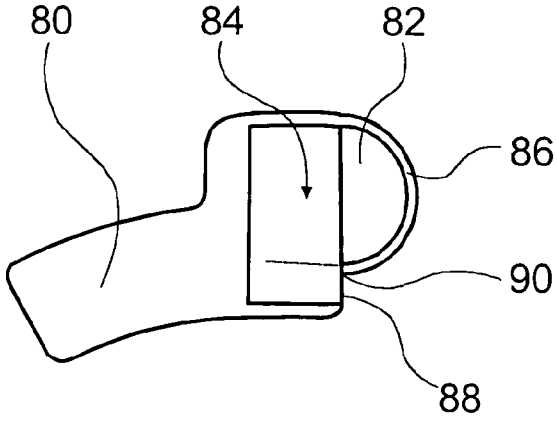

FIG. 6 shows a further embodiment of an opening 80 in the hub. A retaining element 82 of a fastening means 84 has a rounded shape, as does a corresponding rear region 86 of opening 80. A stop 88 of opening 80 is shorter in design than stop 66 of opening 42, so that a convex section 90 designed as a sharp corner directly abuts stop 88. Fastening means 40 and 84, and openings 42 and 80 are otherwise identical in terms of shape and dimensions.

What is claimed is:

1. An insertion tool (12) for a machine tool, wherein the insertion tool (12) has a hub (16) with at least one opening (42, 80) for insertion of a fastening means (40, 84), wherein the hub (16) is clampable by means of the fastening means (40, 84) on a driving flange (22) connected to a drive shaft of the machine tool, the opening (42, 80) including a retaining region (54) and a releasing region (56), the releasing region (56) including a stop (66, 88) for limiting a release motion of the fastening means (40, 84) wherein the opening (42, 80) has a convex section (76, 90) adjacent to the stop (66, 88) and with a rear region (76, 90) which is realized due to the convex section (76, 90) and which is arranged in a release direction (64) behind the stop (66, 88).

2. The insertion tool (12) as recited in claim 1, wherein the opening (42, 80) has a section (72) that, in the circumferential direction (30), is at least 2 mm further away from the retaining region (54) than the stop (66, 88).

3. The insertion tool (12) as recited in claim 1, wherein the stop (66, 88) is oriented such that it is rotated by an angle between 2° and 10° against a direction of rotation of the release motion of the fastening means (40, 84) relative to the radial direction.

4. The insertion tool (12) as recited in claim 1, wherein the opening (42, 80) has a convex, radial, inner section (78) oriented in the circumferential direction (30).

5. The insertion tool (12) as recited in claim 1, wherein the opening (42, 80) has two parallel, interconnected slots.

6. The insertion tool (12) as recited in claim 5, wherein each of the slots is at least substantially right-angled.

7. The insertion tool (12) as recited in claim 5, wherein each of the slots is oriented in the circumferential direction (30).

8. The insertion tool (12) as recited in claim 1, wherein the hub (16) includes retaining means for fixing the hub (16) in the circumferential direction (30).

9. The insertion tool (12) as recited in claim 1, wherein the hub (16) includes a centering opening (26) for centering the hub (16).

10. The insertion tool (12) as recited in claim 9, wherein the centering opening (26) includes at least one radial recess (32).

11. The insertion tool (12) as recited in claim 1, wherein the opening (42, 80) has a section (72) that, in the circumferential direction (30), is at least 3 mm further away from the retaining region (54) than the stop (66, 88).

12. The insertion tool (12) as recited in claim 1, wherein a straight line, which extends through the longitudinal direction of the stop (66, 88), is arranged eccentrically with respect to a center of the hub (16).

13. A cutting disc (12) for a machine tool, wherein the cutting disc (12) has a hub (16) with at least one opening (42, 80) for insertion of a fastening means (40, 84), wherein the hub (16) is clampable by means of the fastening means (40, 84) on a driving flange (22) connected to a drive shaft of the machine tool, the opening (42, 80) including a retaining region (54) and a releasing region (56), the releasing region (56) including a stop (66, 88) for limiting a release motion of the fastening means (40, 84), wherein the opening (42, 88) has a convex section (76, 90) adjacent to the stop (66, 88) and with a rear region (76, 90) which is realized due to the convex section (76, 90) and which is arranged in release direction (64) behind the stop (66, 88).

* * * * *